US005533262A

United States Patent [19]

Clark

[11] Patent Number: 5,533,262

[45] Date of Patent: Jul. 9, 1996

[54] SINGLE CUT CLIPPER FOR NAILS

[76] Inventor: Richard N. Clark, 2455 E. West Maple Rd., P.O. Box 9027, Walled Lake, Mich. 48390-9027

[21] Appl. No.: 242,465

[22] Filed: May 13, 1994

[51] Int. Cl.[6] ..... A45D 29/00

[52] U.S. Cl. ..... 30/29; 30/242

[58] Field of Search ..... 30/29, 28, 242, 30/184; 132/75.4, 75.5

[56] References Cited

U.S. PATENT DOCUMENTS

| | | |
|---|---|---|
| 165,402 | 7/1875 | Bates . |
| 205,088 | 6/1878 | Hollman . |
| 1,347,651 | 7/1920 | Nauth . |
| 1,927,234 | 9/1933 | Hawkins . |
| 2,820,292 | 1/1958 | Bouten et al. . |
| 2,955,354 | 10/1960 | Laing . |
| 3,101,535 | 8/1963 | Andis . |
| 3,299,505 | 1/1967 | Pionek . |
| 3,430,340 | 3/1969 | Perles . |
| 3,838,507 | 10/1974 | Clark . |
| 3,845,553 | 11/1974 | Fields . |
| 3,855,699 | 12/1974 | Charlett . |
| 3,903,596 | 9/1975 | Crosby . |
| 4,228,585 | 10/1980 | Nelson . |
| 4,449,297 | 5/1984 | Fuchs et al. . |
| 4,856,190 | 8/1989 | Reiswig . |
| 5,065,513 | 11/1991 | Reiswig . |
| 5,101,563 | 4/1992 | d'Orgelys . |
| 5,123,430 | 6/1993 | Davidovitz . |

*Primary Examiner*—Douglas D. Watts

*Attorney, Agent, or Firm*—Barnes, Kisselle, Raisch, Choate, Whittemore & Hulbert

[57] ABSTRACT

A cutting blade actuating link for actuating a cutting blade of a guillotine-type animal nail or artificial nail clipper. The link is in the form of a thin flat body having an integral hook formation at one end adapted for insertion into an aperture in the blade and a blade-release finger tab at the opposite end. The link hook has an inside peripheral edge concave surface to thereby define a hook eye interior surface inclined generally at an acute angle relative to the longitudinal axis of said body. The link has a dumb bell shaped through-opening for receiving both a pivot pin for mounting the blade to the clipper handle and the hook end of the clipper handle spring. Progressive die stamping method, apparatus and punch and die tooling are also disclosed for making the link.

17 Claims, 4 Drawing Sheets

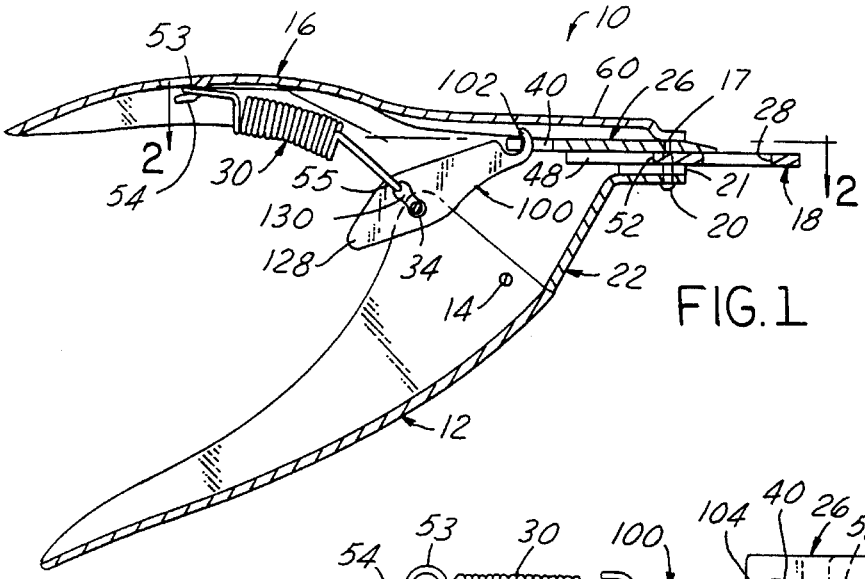
FIG. 1
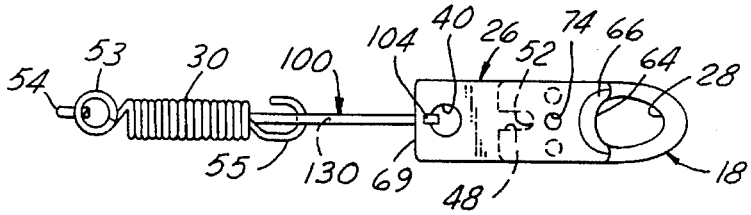
FIG. 2
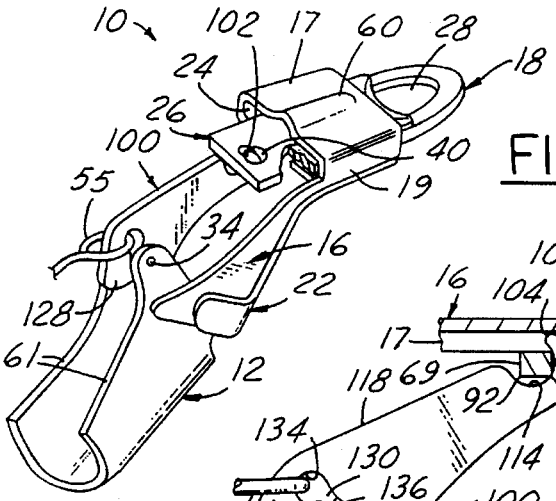
FIG. 3
FIG. 4
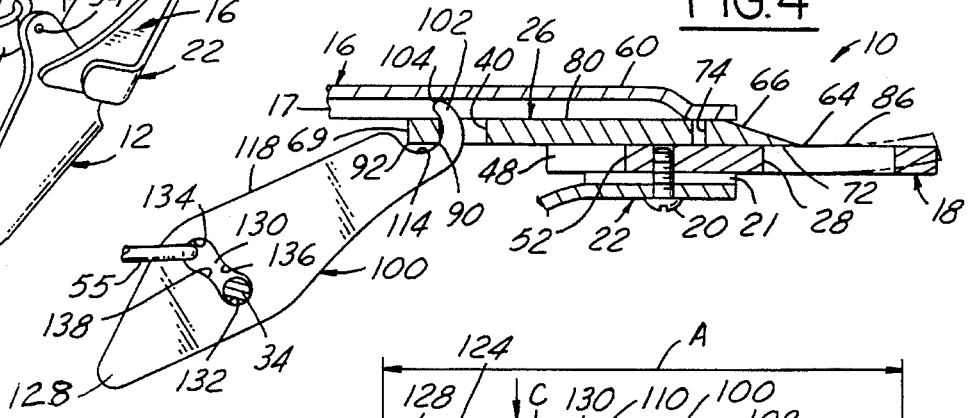
FIG. 5
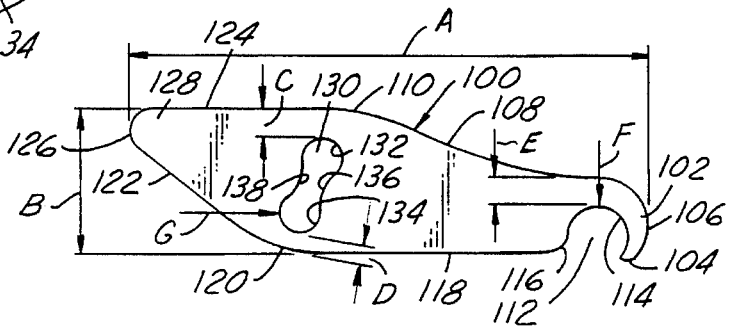
FIG. 6
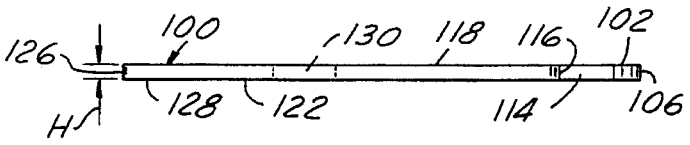

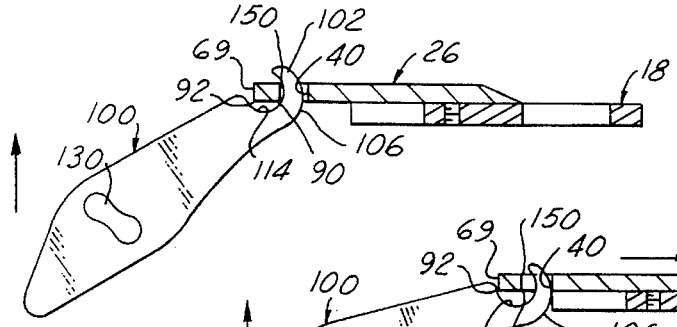
FIG.7A
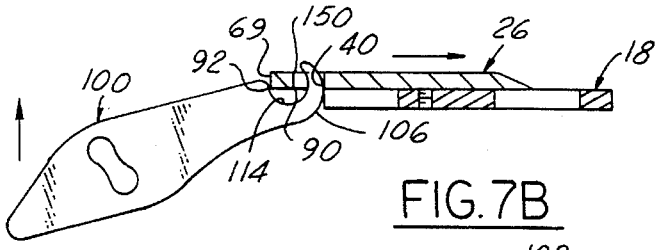
FIG.7B
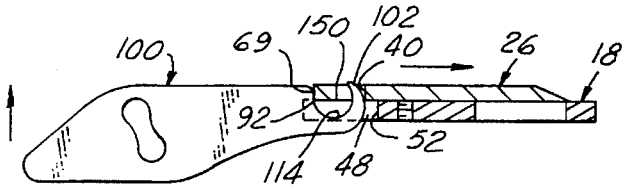
FIG.7C
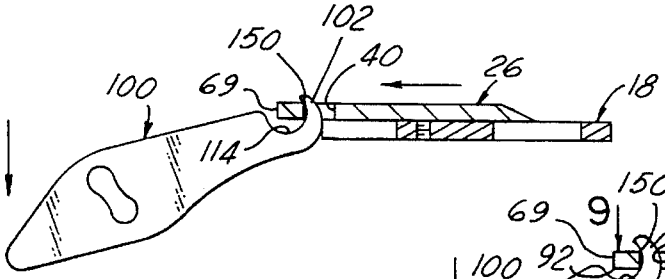
FIG.8A
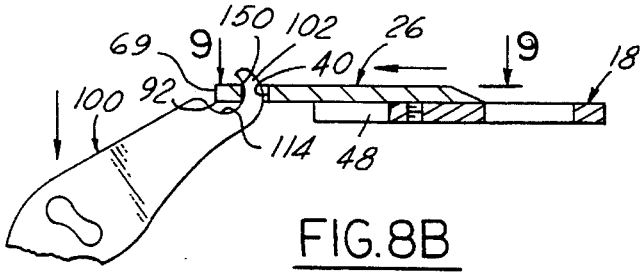
FIG.8B
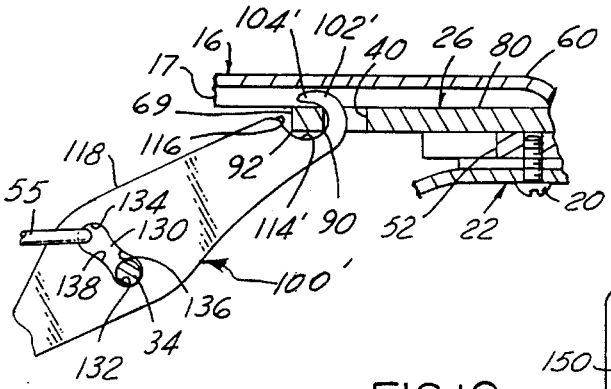
FIG.9
FIG.10
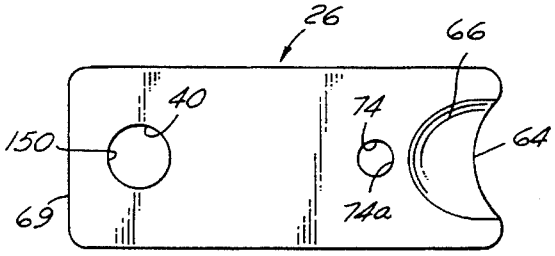

SINGLE CUT CLIPPER FOR NAILS

FIELD OF THE INVENTION

This invention relates to a guillotine-type cutter useful as a nail clipper for trimming the nails of an animal, such as a dog or cat or for clipping natural or artificial finger or toe nails of a human, and more particularly to the cutting blade actuating linkage employed in such nail clippers.

BACKGROUND OF THE INVENTION

Professional quality animal nail clippers used by both veterinarians and animal owners in trimming the nails of animals, such as those of dogs and cats, have been successfully made and sold for over forty years under the trademark "RESCO" by Tecla Company, Incorporated of Walled Lake, Mich. Such clippers were initially made in accordance with the principles and features of the Laing U.S. Pat. No. 2,955,354 and later pursuant to the improvements of the Clark U.S. Pat. No. 3,838,507, both incorporated herein by reference. More recently a nail clipper of this type has been successfully modified for use in clipping human artificial fingernails by employing the principles and features of the Reiswig U.S. Pat. No. 4,856,190, also incorporated herein by reference. Other prior art patents of general interest directed to guillotine-type cutters and clippers are disclosed in the following U.S. patents:

| | | |
|---|---|---|
| 165,402 | Bates | 07-13-75 |
| 205,088 | Hollman | 06-18-78 |
| 1,347,651 | Nauth | 07-27-20 |
| 1,927,234 | Hawkins | 09-19-33 |
| 2,820,292 | Bouten et al | 01-21-58 |
| 2,955,354 | Laing | 10-11-60 |
| 3,101,535 | Andis | 08-27-63 |
| 3,299,505 | Pionek | 01-24-67 |
| 3,430,340 | Perles | 03-04-69 |
| 3,838,507 | Clark | 10-01-74 |
| 3,845,553 | Fields | 11-05-74 |
| 3,855,699 | Charlett | 12-24-74 |
| 3,903,596 | Crosby | 09-09-75 |
| 4,228,585 | Nelson | 10-21-80 |
| 4,449,297 | Fuchs et al | 05-22-84 |
| 4,856,190 | Reiswig | 08-15-89 |
| 5,065,513 | Reiswig | 11-19-91 |
| 5,101,563 | d'Orgelys | 04-07-92 |
| 5,123,430 | Davidovitz | 06-23-92 |

In general, the nail clippers made pursuant to the aforementioned Clark '507 patent comprise a guillotine-type cutter with two blades. One blade is a movable cutting blade reciprocated in a single cutting stroke by manually squeezing together the handles of the clipper against the force of a biasing spring coupled between the handles. The second blade serves as the nail retainer blade and thus has an oblong, circular or other specially shaped opening to closely receive therethrough the nail to be cut, and is attached to the larger of the two handles with one or two screws or rivets. A blade actuating link (part 32 of the Clark '507 patent and part 44 of the Reiswig '190 patent) is operatively coupled between the clipper handles and the cutting blade so that when the user squeezes the two handles together, the link pushes the cutting blade forward on its cutting stroke so that it meshes with and travels by the retainer blade. The object to be cut (e.g., animal nail) is held in the retainer blade opening so that closing the clipper handles drives the cutting edge of the cutting blade through the object to sever it. The user then releases the clipper handles, allowing the spring to pull the link which in turn pulls the cutting blade back as the handles return to their fully opened position, ready for the next cutting stroke.

Based upon the aforementioned long commercial experience, it has been found that, for the nail cutting action to work properly, some of the essential operational features are: (1) the cutting blade has to have a sharp cutting edge; (2) the cutting blade has to slidably mesh tightly with the retainer blade during the entire cutting stroke; and (3) the cutting blade should travel for a substantial distance beyond the retainer blade opening to insure that the object is severed cleanly.

Typically the cutting blade is a flat part made from hardened tool steel or stainless steel in a progressive die stamping operation. The cutting blade is ground flat on one side and a cutting edge is ground the opposite-side, and has holes or slotted openings to releasably retain or accept the link adjacent its rearward end. The retainer blade is made of like material in a progressive die stamping operation likewise ground flat. Preferably, certain slight curvatures are imparted to the cutting blade and retaining blade surfaces, as described in conjunction with the embodiment of FIG. 7 of the Clark '507 patent, to insure that the under surface of the cutting blade adjacent its cutting edge is forced closely against the upper surface of the nail holder as it slides therealong in the cutting stroke.

The large handle of the clipper typically is a stamped metal or plastic molded part to which the retainer blade is attached by one or two screws. The large handle carries a pivot pin pivotably supporting the small handle thereon.

The blade actuating link is a thin, flat progressive die stamped part that is pivotably attached near one end to the small handle, typically with a rivet. The link has a small hole adjacent the pivot pin connection to which one end of a extension coil spring is attached, the other end of the coil spring being hooked to the inside of the large handle to thereby yieldably pull the handles apart or to their fully opened positions. The forward end of the link has a notch forming a projection hook which extends through a hole in the cutting blade located near its rear edge. The material in the blade between the link hole and rear edge-of the blade forms a transverse bar extending across the link notch which the link alternately pushes and pulls on in the cutting and retraction strokes of the clipper. Although this crossed hook and bar means forms an easily releasable connection between the link and cutting blade, the link must also remain operable to alternatively push and pull the cutting blade during the blade cutting and retraction strokes respectively and therefore must stay engaged with the blade throughout these strokes and during stroke reversal.

One of the unique features of this type of linkage, as set forth more fully in the aforementioned Clark '507 patent, is that it is possible to remove the cutting blade without taking the assembly apart. The cutting blade is provided with an extra hole near its forward end for receiving a holding pin to temporarily hold the blade fixed in its extended position. The link has a tab protruding rearwardly beyond its handle pivot mounting which can be finger depressed to disengage the forward end of the link from the cutting blade and then be loosely abutted against the rear edge of the cutting blade. The retaining pin is then removed to thereby eject the cutting blade and the handles are then squeezed for easy removal from the clipper. The replacement blade can then be readily installed by reversing this procedure.

Although the aforementioned "RESCO" nail clipper has long been commercially successful and accepted as "the standard of the industry" in the veterinary profession for animal nail trimming, nevertheless certain long standing problems have remained in its manufacture and use, centering around the construction of the link 32 of the Clark '507 patent and the corresponding link 44 of the Reiswig '197 patent. These links have a contour with a rectangular notch or recess near the forward end, i.e., notch 36 of the '507 patent link 32 defined by a pushing surface 42, a bottom bearing surface 44 and a pulling surface 46 which engage the portion of the cutting blade 26 between the cutting blade hole 40 and the rear edge 69 of the blade, and similarly notch 48 of link 44 of the '190 patent. This hook configuration works adequately during the forward or cutting stroke. However, on occasion link 32 inadvertently can be pulled out of the cutting blade 26 on the retract or opening stroke, if the cutting blade becomes bound or otherwise restricted during this stroke. Also, if the nail trimmer is inadvertently dropped by the user, the link will sometimes disengage itself from the cutting blade, thereby creating a nuisance for the user and a possibly serious interference during some nail trimming circumstances.

In one proposal to solve this unwanted unhooking problem, it was suggested that the front wall 46 of the notch was to be ground after stamping to provide an acute angle or undercut to create a camming effect so that the link would more readily stay removably engaged in the cutting blade. However this would be a very labor intensive operation which would add considerable manufacturing expense to the clipper. Although this undercut angle alternatively could be imparted in the progressive die operation, thereby eliminating a grinding operation, this would cause die wear and breakage problems. Also, whether undercut or not, the rectangular configuration of the notch at the front of the link has caused added expense in the manufacture of the precision punch dies and made them prone to breakage, and also made the part as punched susceptible to burrs. Likewise, the outer perimeter of the die punch in the vicinity of the notch has areas with straight intersections at the corner that make the punch die susceptible to undue wear and breakage problems.

Another problem experienced with the link 32 of the Clark '507 patent arises from the provision of a small diameter hole 56, which receives the end hook 55 of the tension coil spring 30, and another small diameter hole which receives the pivot pin 34 for pivotally coupling link 32 to the small handle 12. These two small diameter holes require delicate punches to form the same, leading to manufacturing problems of punch breakage and/or formation of burred holes.

Another problem encountered with these small diameter link holes is "slug return". Slug return occurs when the slug of metal punched out by the punch from the sheet metal strip blank clings to the punch on the downstroke (piercing stroke) and then remains on the punch during retraction above the die section, instead of being stripped and ejected below the blank as intended. This in turn can, and often does, cause the strip stock being stepwise fed through the progressive die press to jam up, thereby requiring the press to be stopped and the die cleared before production can resume. Slug return thus represents an expensive problem whenever it is encountered in production.

OBJECTS OF THE INVENTION

Accordingly, it is an object of the present invention to provide an improved guillotine-type cutter of the aforementioned type and an improved cutting blade actuating link therefor which overcome the aforementioned problems in an efficient and reliable manner, while retaining the desirable feature of the cutting blade being readily removable and replaceable by hand without disassembly of the clipper as in the aforementioned successful prior art '507 patent clipper.

Another object is to provide an improved blade actuating link for use in nail clippers of the type disclosed in the aforementioned '507 and '190 patents which overcomes the aforementioned problems, and which is directly substitutable for the prior blank actuating link of such existing commercial clippers without requiring any other change in the construction of the remaining parts of such clippers.

Yet another object is to provide an improved blade actuating link of the aforementioned character which is smoother acting and longer lasting in operation than the prior link described above, and which is less expensive to manufacture and more reliable in operation.

A further object of this invention is to provide an improved method of manufacturing a cutting blade actuating link of the aforementioned character and an improved punch and die apparatus for performing this method, and which cooperate with the improved link construction to overcome the aforementioned problems encountered in manufacture of the prior link in a more efficient, economical and reliable manner, both with respect to the operation of the apparatus in performance of the method and construction of the apparatus employed to perform the method.

DESCRIPTION OF THE DRAWING FIGURES

The foregoing as well as other objects, features and advantages of the present invention will become apparent from the following detailed description, appended claims and accompanying drawings (which are to scale unless otherwise indicated) wherein:

FIG. 1 is a side view in vertical section of a nail clipper embodying the present invention.

FIG. 2 is a horizontal fragmentary plan view of a portion of the nail clipper of FIG. 1 taken on the line 2—2 of FIG. 1.

FIG. 3 is a fragmentary perspective view of a portion of the nail clipper of FIG. 1.

FIG. 4 is a fragmentary vertical center sectional view of a portion of the nail clipper structure shown in FIG. 1 but enlarged in scale thereover.

FIG. 5 is a plan view of an exemplary but preferred embodiment of an improved cutting blade actuating link of the invention shown by itself with various exemplary but preferred dimensional parameters delineated thereon.

FIG. 6 is a side elevational view of the link shown in FIG. 5.

FIGS. 7A, 7B and 7C are diagramatic figures illustrating the relative positions of the link, cutting blade and retainer blade of the clipper of FIG. 1 respectively in the fully retracted position of the blade (FIG. 7A), midway on the pushing/cutting stroke (FIG. 7B), and at the end of the cutting stroke (FIG. 7C).

FIGS. 8A and 8B are illustrations similar to those of FIGS. 7A–7C and illustrating respectively the blade midway on its retraction stroke (FIG. 8A) and at the completion of its retraction stroke (FIG. 8B).

FIG. 9 is a fragmentary vertical center sectional view of an alternative embodiment of an improved animal nail cutting blade actuating link also in accordance with the present invention.

FIG. 10 is a plan view of the existing commercial animal nail cutting blade employed in the nail clipper of FIGS. 1–4, as well as that illustrated in FIGS. 7A–8B.

Figure 11:
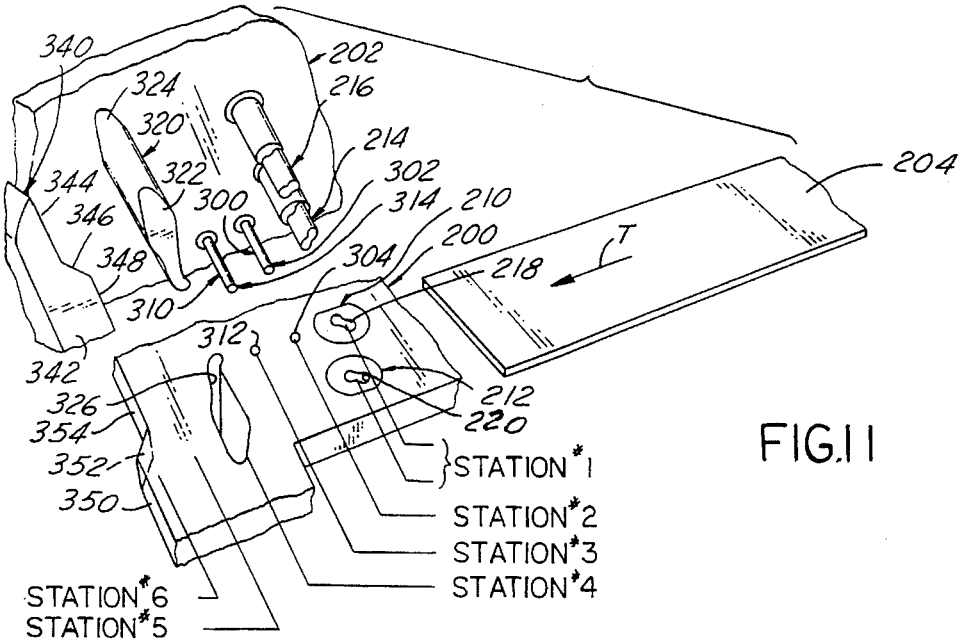

FIG. 11 is a fragmentary perspective view of an exemplary but preferred embodiment of the improved progressive stamping punch and die apparatus of the invention employed in performing the improved method of the invention, with the punches and punch holder rotated 90° relative to their operative position wherein the punches are coaxially aligned with the associated die cutting pocket surfaces provided in a die holder in the companion die set.

FIGS. 12A, 12B, 12C, 12D, 12E and 12F are sequential fragmentary plan views of the progressive die punched strip stock and associated punch and die apparatus of FIG. 11 illustrating the method of punching the strip workpiece as it is progressively die punch formed in stepwise feeding progressively through the punch and die tooling apparatus of the invention to form the improved cutting blade actuating link of the invention shown in FIGS. 1–8B.

Figure 13:
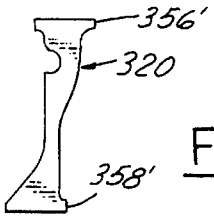

FIG. 13 is a fragmentary plan view illustrating the scrap strip cut-off piece formed at the sixth and final station 6 in the apparatus of FIG. 11.

Figure 14:
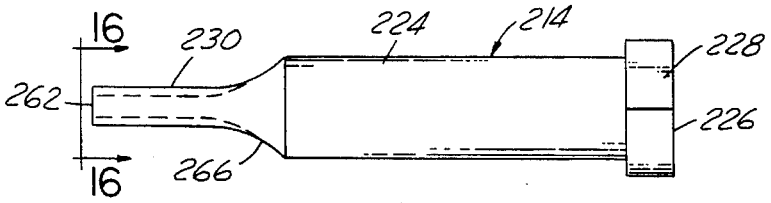

FIG. 14 is a side elevational view of an improved pierce punch employed in the punch and die method and apparatus of the invention for punching the interior configuration of the hook end of the improved link of the invention.

Figure 15:
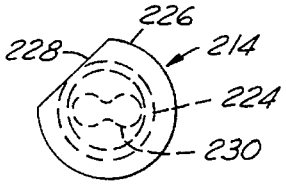

FIG. 15 is an elevational view of the right hand end of the punch as illustrated and viewed in FIG. 14.

Figure 16:
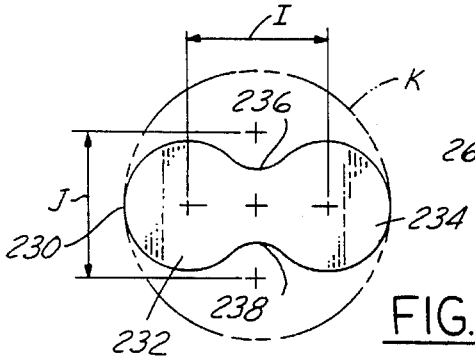

FIG. 16 is a view taken on the line 16—16 of FIG. 14 but greatly enlarged thereover, and illustrating the detail of the punch face alone with dimensional parameters delineated thereon.

Figure 17:
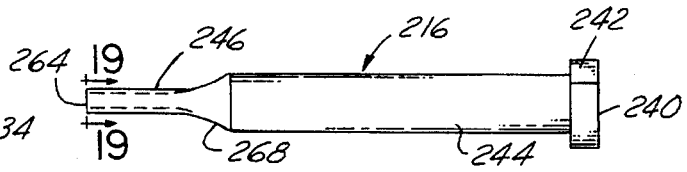

FIG. 17 is a side elevational view of the punch employed in the punch and die apparatus and method of the invention for pierce forming the dumb-bell shaped interior opening in the link of the invention for receiving therethrough both the link pivot pin and spring hook as shown in FIG. 1.

Figure 18:
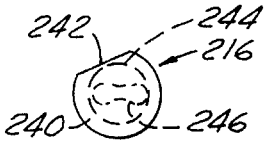

FIG. 18 is a elevational view of the right hand end of the punch as illustrated and viewed in FIG. 17.

Figure 19:
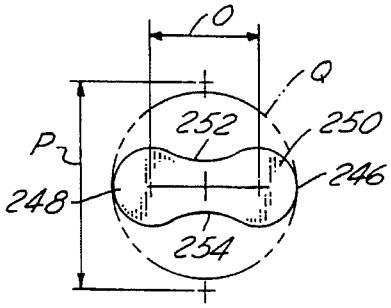

FIG. 19 is a view taken on the line 19—19 of FIG. 17 but greatly enlarged thereover, and illustrating the detail of the punch face alone with dimensional parameters delineated thereon.

Figure 20:
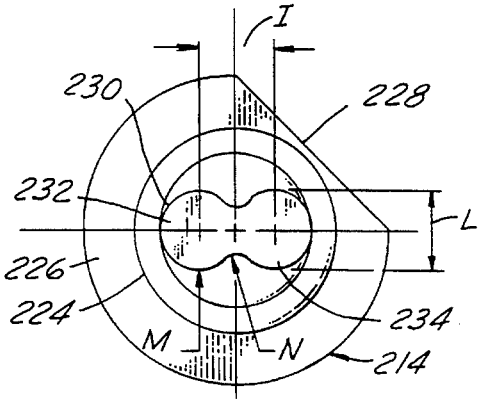

FIG. 20 is an end elevational view of the left hand end of the punch as viewed and illustrated in FIG. 14 but enlarged thereover.

Figure 21:
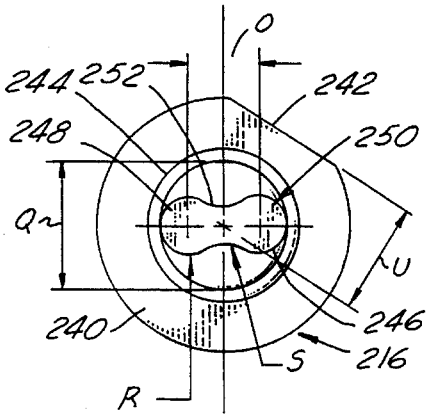

FIG. 21 is an end elevational view of the left hand end of the punch as illustrated and viewed in FIG. 17 but enlarged thereover.

DETAILED DESCRIPTION OF PREFERRED EMBODIMENTS

General Construction and Operation of Clipper 10

Referring in more detail to the accompanying drawings, FIGS. 1–4 illustrate a preferred embodiment of an animal nail clipper 10 embodying the present invention and provided with an improved blade actuating link 100 made in accordance with the construction, method and apparatus of the present invention. Inasmuch as the components, and construction and general mode of operation of clipper 10 are identical to that of clipper 10 as disclosed in the aforementioned Clark U.S. Pat. No. 3,838,507, but for the replacement of link 32 therein by link 100 of the present invention, for purposes of brevity the reference numerals employed in FIGS. 1–8B and 10 are identical to those appearing in the Clark '507 patent and the detailed description thereof not repeated herein. However, for convenience of the reader the following identification of components and constructional features are set forth to facilitate cross reference:

12—lower or smaller handle
14—handle pivot pin
16—upper or large handle and body
18—nail holder
20—assembly screws
22—front cover
17—top wall of handle 16
19—opposite side walls of handle 16
21—in-turned flanges of side walls 19
24—rectangular passageway in handle 16
26—cutting blade
28—nail receiving aperture in holder 18
30—tension coil spring
34—pivot pin for actuator link 100
40—link connecting latch hole in blade 26
48—slot in rear portion of nail holder 18
52—terminal end stop of slot 48
53—hook at one end of spring 30
54—struck-down tab on handle 16
55—hook at other end of spring 30
56—hole for spring end hook 55
60—rib in handle 16 providing clearance groove in passageway 24
61 and 61'—spaced edges of handle 12
64—cutting edge of blade 26
66—inclined surface of cutting edge 64
68—cutting edge apex of cutting edge 64
72—bottom face of blade 26
69—rear edge surface of blade 26
74—release pin hole in blade 26
90—rear edge of hole 40 at intersection with undersurface 84 of blade 26
92—lower rear corner edge of blade 26

It is also to be understood that the preferred embodiment of clipper 10 as described and illustrated in conjunction with FIG. 7 of the aforementioned Clark '507 patent is also that preferred in present clipper 10. The additional features described and illustrated in conjunction with FIGS. 8–11 of the aforementioned Clark '507 patent may also be utilized in conjunction with clipper 10 of the present invention.

Blade Actuating Link 100

In accordance with a principal feature of the present invention, an improved blade actuating link 100, preferably constructed in accordance with the embodiments of the improved method and apparatus of the invention described hereinafter in conjunction with FIGS. 11–21, is provided for use as a direct replacement for link 32 of clipper 10 of the aforementioned Clark '507 patent. Referring to FIGS. 5 and 6, link 100 in its entirety is a thin, flat planar metal part made as a progressive die stamping from hardened strip steel, such as C-1074 spring steel. Link 100 is characterized in plan view (FIG. 5) by a contour and configuration (in the plane of the drawing—which is also the major plane of the link)

resembling a "fat fish hook", and thus has a curved tapering hook portion 102 at its forward end of narrow width tapering down to a somewhat blunt point 104 at its free end. The end edge surface 106 of hook 102 is formed on a constant radius of curvature and extends for approximately 170° from point 104 rearwardly to where it merges, through a reverse curvature, with a slightly concave link perimeter edge surface 108 which in turn merges with a slightly convexly curved central perimeter edge surface 110.

The "eye" of hook 102 is an opening 112 defined by an inner curved edge surface 114 having a constant radius of curvature and extending for approximately 190° from point 104 rearwardly to a convexly curved corner radius edge surface 116. Corner surface 116 in turn merges with a substantially straight perimeter edge surface 118 disposed opposite edge surface 108. Surface 118 merges with a convexly curved central surface 120 which, in conjunction with edge surface 110 defines the "fat" central portion of the body of link 100.

The rearward end of link 100 is defined by oppositely disposed straight perimeter edge surfaces 122 and 124 which converge into a rearward apex surface 126 formed on a constant radius of curvature to thereby form a tapered, finger-engageable tab portion 128 of link 100. Surfaces 122 and 124 converge at an included angle of about 41°.

In accordance with another feature of link 100 of the invention, a "dumb bell" or "figure 8", shaped opening 130 of symmetrical configuration is provided in the "fat" central portion of link 100, between the opposed convex surfaces 110 and 120. Opening 130 is defined by diametrically opposed curved end surfaces 132 and 134 each formed on a constant radius of curvature each having the same diameter and each extending approximately 200°. Surfaces 132, 134 converge with laterally opposed convexly curved side surfaces 136 and 138, each having the same constant radius of curvature, and defining the narrow "waste" of the dumb bell opening 130.

In one working embodiment of link 100 the following geometric and dimensional parameters have been successfully produced and utilized, as indicated by the dimensional indicia provided in FIGS. 5 and 6 as follows:

| | | |
|---|---|---|
| A | overall length of link 100 | 31.73 mm (1.25 in) |
| B | maximum width between surfaces 110 and 120 | 10.2 mm (.40 in) |
| C | width between the surface 124 and tangent line from surface 132 parallel to surface 124 | 1.65 mm (.065 in) |
| D | minimum width between surface 134 and surface 120 | 1.40 mm (.055 in) |
| E | minimum width between parallel tangent lines drawn parallel to surface 118 and tangent to surfaces 106 and 114 | 1.522 mm (.060 in) |
| F | diameter of eye opening 112 | 3.17 mm (.125 in) |
| G | diameter of surfaces 132 and 134 | 2.37 mm (.0935 in) |
| H | uniform thickness of link 100 | 1.77 mm (.070 in) |

Referring again to FIGS. 1–4, it will be seen that link 100 is operably assembled in clipper 10 as a direct substitute for the prior link 32 of the clipper disclosed in the aforementioned Clark '507 patent. The link pivot pin 34, preferably a rivet, is inserted with a close sliding fit through the one of the two partially closed end openings of dumb bell opening 130 closest to hook 102 so as to be captured within dumb bell curved end surface 132. The hook end 55 of spring 30 is inserted through the other of the two end openings of dumb bell opening 130 so as to hook engage the curved end surface 134. It will be seen that the dumb bell opening 130 thus provides a dual engagement opening in link 100 for operably interconnecting both pivot pin 34 and spring hook 55 with link 100 to function in the manner previously requiring the two separate small diameter circular openings (i.e., unnumbered hole for pin 34 and hole 56 for spring end hook 55) in the prior link 32, of the Clark '507 patent.

Hook 102 of link 100 is releasably engaged with blade 26 by insertion in blade opening 40 so as to protrude therethrough and is operable to exert the push-pull blade actuating forces imparted to link 100 by squeezing together and then releasing clipper handles 12 and 16, thereby respectively advancing blade 26 on its cutting stroke and retracting blade 26 on its return stroke. The respective retracted positions of link 100 and blade 26 are shown in FIGS. 1, 3 and 4. The relative positions of link 100, blade 26 and nail retainer 18 during the push-mode in advancing blade 26 on its cutting stroke are partially shown in sequence in FIGS. 7A, 7B and 7C. Similarly, the relative positions of these parts during the pull-mode in retracting blade 26 on its return stroke are partially shown in sequence in FIGS. 8A and 8B.

Referring in more detail to FIG. 7A, link 100 is illustrated generally at the angulation relative to blade 26 corresponding to the fully opened position of handles 12 and 16 shown in FIG. 1. As the closing force is applied to the handles by the user manually squeezing the same together, pivot pin 34 pushes link 100 in the forward direction as pin 34 is forcibly carried by handle 12 to bodily swing about the axis of handle pivot pin 14. This causes link 100 to move bodily from the position shown in FIG. 7A through the position of FIG. 7B to the position of FIG. 7C (handles fully closed blade 26 fully advanced to the end limit of its cutting stroke). The reaction forces exerted on link 100 by blade 26 (initially low due only to the frictional resistance to its sliding motion and then high due to the much greater resistance offered by the object being cut and severed by the blade while held by holder 18) produce a sliding abutment-type engagement between the lower rear corner edge 92 of blade 26 and the portion of the link eye surface 114 contiguous with the link corner radius surface 116 generally where they meet and form an "S" curvature. A slight clearance remains between hook end surface 106 and the adjacent forward edge surface of blade latch hole 40 when the link is pushing the blade during push stroke. Since the link abutment surfaces 114 and 116 present a smoothly curved surface, blade latch edge 92 can readily slide along surface 114 to accommodate the changing angulation between the link and blade during this push stroke. It is also to be understood that the tension force exerted by spring 30 on link 100 develops a hook engagement retaining torque about pivot pin 34 tending to continuously urge link 100 against blade 126 and force link hook 120 into blade hole 40 throughout both the push and pull strokes of link 100.

As the user begins to release the grip on the handles 12 and 16 to initiate the blade retraction stroke, hook 102 will be drawn to move within blade hole 40 to the left, away from its relative position in blade hole 40 shown in FIG. 7C, thereby causing link hook surface 114 to slidably hook-engage the rear edge of blade hole 40 as shown in FIG. 8A. More particularly, the slight resistance to return motion of blade 26 will cause the rear upper edge 150 of blade hole 40 to engage hook eye surface 114 adjacent point 104 of link hook 102. Due to the curvature angulation of hook eye surface 114 in this area relative to blade 26, a resultant camming force will be developed in response to the link pull force tending to force hook 102 to enter further into blade hole 40, and which is cumulative to the hooking fore of spring 30, thereby insuring a firm latch hooking engagement of the link and blade for reliably retracting blade 26 throughout its return stroke (as seen in FIGS. 8A and 8B as well as FIG. 1) without danger of the pop-out disengagement occurring as discussed previously.

It thus will be seen from the foregoing that link 100 and blade 26 have a releasable latch-type engagement, as well as a push-pull force transmitting engagement. That is, the blade material in the rear portion of blade 26 defined between the rear upper and lower edges 150 and 90 respectively of blade latch hole 40 and the lower rear corner edge 92 of the rear edge surface 69 of blade 26 forms and functions as a "latch bar" that is releasably received within the eye 112 of latch hook 102 and extends perpendicular to the major plane of line 100. This rear edge latch bar material of blade 26 also provides the driven coupling member cooperative with the driving hook 102 of link 100 in the foregoing "push-pull" blade actuations.

In addition, since spring 30 is designed and constructed to exert a continuous tension force on link 100, spring hook 55 will always remain securely attached to the link within the upper end of link opening 130 (as viewed in FIGS. 1, 3 and 4) and will readily slide along the smoothly curved surface 134 of opening 130 during the changing angulation of link 100 relative to blade 26. Also, because pivot pin 34 has a diameter which cannot pass through the narrow space defined between the hour-glass shaped "waist" surfaces 136 and 138 of opening 130, pin 34 will remain captured in the lower end of the "dumb bell" shaped opening 130 regardless of the direction and/or magnitude of the forces exerted between link 100 and pin 134. However due to the tension exerted by spring 30, pin 34 will be forced to ride continuously in the closed end of the smoothly curved surface 132 during both closing and opening of handles 12 and 16.

Method and Apparatus for Manufacturing Link 100

In accordance with a further feature of the present invention, link 100 is preferably manufactured utilizing the improved tooling apparatus of the invention operated to perform the improved method of the invention as illustrated in FIGS. 11–21. This method is preferably performed utilizing a commercially available progressive die stamping machine of conventional construction (not shown) having a conventional stock feeder (not shown) which is operable to intermittently feed a coil of steel strip stock in flat form in precisely controlled equal increments through the punch and die station of the press, as will be well understood by those skilled in this art. However, special punch and die tooling constructed and arranged in accordance with the present invention is provided in such a progressive die stamping press as shown in FIGS. 11–21.

Referring first to the semi-schematical illustration of FIG. 11, the punch and die tooling of the invention includes a die holder 200 and an associated punch holder 202 which are respectively fixtured in a stationary die bed support structure of the press and in a vertically reciprocable platen punch support structure of the press in the usual manner. In FIG. 11 the punch holder 202 is shown bodily rotated up 90° from its normal horizontal position to facilitate illustration and understanding of the punch tooling, it being understood that in normal use the axes of the punches are oriented facing vertically downwardly and parallel to the vertical travel of the punch platen of the press. FIG. 11 also fragmentarially illustrates the flat strip of 204 of steel starting stock as it is fed toward the punch and die tooling of the press in the direction of the travel arrow T. The conventional strip feeder is operated such that strip 204 is advanced or indexed the same fixed distance each time it is intermittently fed, in accordance with conventional practice. In accordance with the mode of operation of the punch and die tooling 200, 202 of the invention, and pursuant to practicing the steps of the method of the invention, the punch and die tooling is constructed and arranged in six sequential operation stations labeled as stations #1, #2, #3, #4, #5 and #6 in FIG. 11. The progressive punching and piloting operations performed simultaneously and sequentially on strip 204 in these stations are illustrated to scale in the corresponding fragmentary views of FIGS. 12A through 12F in which the punch tooling is shown in transverse cross section, as will be explained in more detail hereinafter.

Station #1

In Station #1 (FIGS. 11 and 12A), two openings are simultaneously punched and finish formed in strip 204. The smaller of these two openings, i.e., dumb bell shaped opening 130, is oriented in strip 204 to subsequently serve as opening 130 in link 100. The larger of these two openings, opening 206, is also a "dumb bell" shaped opening. Each of the opposite round ends of opening 206 have the same constant radius of curvature and hence diametrical dimension and each being equal to the diameter of link hook opening 112. The upper left end of opening 206 (as viewed in FIG. 12A) thus as punched has a surface 114' which is oriented in strip 20 to subsequently serve as hook eye surface 114 in link 100. The orientation and spacing of the two openings 130 and 206 formed in Station #1 is thus coincident to the orientation of opening 130 and hook eye surface 114 in the finished linked 100. The punching pattern is laid out relative to strip 204 such that the major axis of link 100 to be formed therein (see FIG. 12D) is transverse to the longitudinal axis of strip 204 (and to the direction of strip travel T) and at an angle of about 80° relative thereto, to thereby optimize pattern nesting in the strip for minimizing scrap waste.

Station #1 Press Dies

The corrollary die tooling employed in Station #1 comprises two die buttons 210 and 212 (FIG. 11) suitably seated and held in die holder 200 oriented for die blanking registration with companion the piercing ends of punches 214 and 216 respectively in the working stroke of the press. Die button 210 has a die-forming through-opening 218 complimental in its longitudinally constant cross section to, and slightly oversized relative to opening 206 to be formed in strip 204 in Station #1. Likewise, die button 212 has a die-forming through-opening 220 complimental in its longitudinally constant cross section to, and slightly oversized relative to opening 130 to be formed in strip 204 in Station #1.

Station #1 Press Punches

The constructional details of punches 214 and 216 employed in Station #1 are best seen in FIGS. 14–21. Punch 214 comprises a cylindrical shank 224 having a mounting head 226 at its upper end (right hand end as viewed in FIG. 14) of cylindrical shade but for a chordal flat 228 provided for proper angular orientation of punch 214 in punch holder 202. The pierce forming end 230 of punch 214 (FIGS. 14, 16 and 20) has a dumb bell shape and longitudinally constant cross section identical to that of opening 206 in strip 204, and is made so as to travel with the usual punch-and-die close clearance coaxial fit into die opening 218 of die button 210. The dimensional layout for the longitudianlly constant cross section of the pierce forming end 230 of punch 214 is illustrated in FIG. 16, as supplemented by FIG. 20.

In the aforementioned working example of link 100 set forth with reference to FIGS. 5 and 6, the following dimensional parameters were observed as illustrated and delineated in FIGS. 16 and 20:

| | | |
|---|---|---|
| I | distance between centers of radii of columnar lobe 232 and 234 of forming end 230 of punch 214 | 3.93 mm (.155 in) |
| J | distance between centers of radius of laterally opposite longitudinally extending concave center surfaces 236 and 238 of forming end 230 of punch 214 | 3.93 mm (.155 in) |
| K | diameter of layout circle tangent to diametrically opposite cross section of peripheries of lobes 232 and 234 | 9.517 mm (.375 in) |
| L | thickness of each lobe 232 and 234 | 3.55 mm (.140 in) |
| M | radius dimension of each lobe 232 and 234 | 1.77 mm (.070 in) |
| N | radius dimension of surfaces 236 and 238 | 1.01 mm (.040 in) |

Referring to FIGS. 17, 18, 19 and 21, punch 216 is similar to, but smaller than, punch 214 and also has a mounting head 240, chordal angular orienting flat 242, cylindrical shank 244 and pierce forming end 246. Forming end 246 likewise has two convex columnar lobes 248 and 250 diametrically opposite one another, and two concave longitudinally extending surfaces 252 and 254 laterally opposite one another between lobes 248 and 250. In the working example as set forth previously for manufacturing link 100, punch 216 was made with the following dimensional perimeters as illustrated and delineated in FIGS. 19 and 21:

| | | |
|---|---|---|
| O | distance between centers of radii of lobes 248 and 250 | 3.55 mm (.140 in) |
| P | distance between center of radii of surfaces 252 and 254 | 6.24 mm (.246 in) |
| Q | diameter of layout circle tangent to diametrically opposite cross section of peripheries of lobes 246 and 248 | 6.35 mm (.250 in) |
| R | radius dimension each lobe 248 and 250 | 1.22 mm (.048 in) |
| S | radius dimension of surfaces 252 and 254 | 2.36 mm (.093 in) |
| U | distance between center of punch 216 and head flat 242 diametrically of punch | 3.17 mm (.125 in) |

In the case of the aforementioned working example dimensions of punches 214 and 216 the working clearance between pierce forming end 230 of punch 214 and die opening 218 is 0.15 millimeters (0.0060 in). The axial length of pierce forming ends 230 and 246 of punches 214 and 216 respectively, extending from their lower end faces 262 and 264 respectively (FIGS. 14 and 17) to their point of convergence with the curved conical shoulders 266 and 268 of punches 214 and 216 respectively, in the case of the aforementioned working example, was 16 millimeters (0.625 in) and 16 millimeters (0.625 in) respectively. The overall axial lengths of punches 214 and 216 are 57 millimeters (2.25 in).

Station #2

Referring again to FIGS. 11–13, in Station #2 (FIG. 12B) the strip holes 206 and 130 which were punched in Station #1 (FIG. 12A) have been advanced in travel direction T from Station #1 and are now registered in Station #2 (the left hand holes 206 and 130 as viewed in FIG. 12B) by causing one increment of travel feed of strip 204 while the punch tooling has been raised clear of the strip. On the next down stroke of the punch tooling a piloting pin 300 (FIG. 11) is inserted into and through the upper circular end of strip hole 206 with a precision sliding fit. Pin 300 thus slidably bears against the surface of strip 204 which is to become hook surface 114 of link 100 as finished.

Punch pilot pin 300 is precision mounted in fixed position in punch holder 202 as shown in FIG. 11. Pin 300 has a conically pointed lower free end 302 to facilitate entry of the cylindrical shank of pilot pin 300 through strip 204 via opening 206.

Die holder plate 200 has a cylindrical hole 304 coaxial with pin 300 and diametrically sized to receive the cylindrical shank of pin 300 with a close sliding fit to accurately guide travel of pin 300 on its working stroke after insertion through strip 204 with hole 206 generally registered with die hole 304 by the strip feeder.

The pointed entrance of pin 300 through strip hole 206 and into die hole 304 enables pilot pin 300 to slightly shift strip 204 as necessary to insure accurate registry of the entire strip layout with the precision placement of the punch and die tooling. Pilot pin 300 thus cooperates with the precision punching operations in Stations #1, #4 and #6 as the punch and die apparatus is cycled repetitively in sequence with the incremental advance of strip 204 through the press. The sliding movement of pin 300 through hole 206 also helps burnish the hook surface 114 subsequent to the initial punching thereof in station 1 (FIG. 12A).

Station #3

Figures 12A, 12B, 12C, 12D:
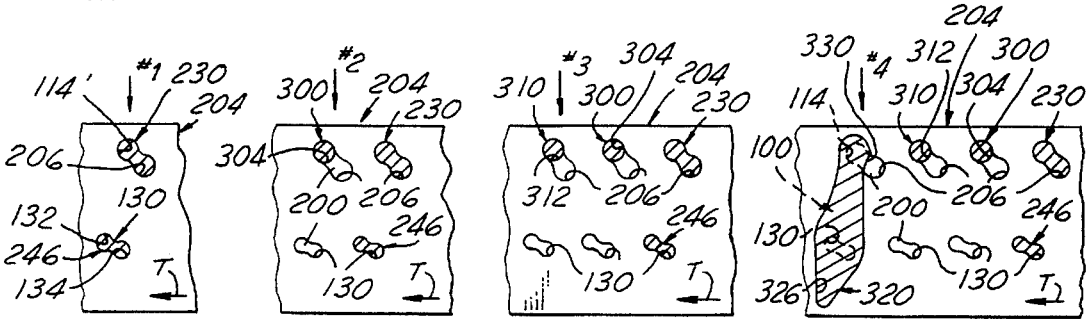

Referring to FIG. 12C as well as FIG. 11, in Station #3 the strip holes 206 and 130 as punched in Station #1 have been further advanced in travel direction T from Station #2 and are now registered in Station #3 (again the left-hand holes 206 and 130 as viewed in FIG. 12C). Again, this occurs in timed relationship with incremental strip feed and press stroke repetitive cycling. Station #3 includes a second pilot pin 310 which enters the upper end of the strip hole 206 as generaly registered in this station by the strip feeder, continues downwardly through strip 204 into another die hole 312 provided in die platen 200 coaxially with pin 310 in Station #3. Pilot pin 310 is identical to pilot pin 300 and likewise has a pointed end 314 (FIG. 11) to provide entry camming action for its cylindrical shank to thereby further assist pin 310 in registering strip 204 accurately with the punch and die tooling in Stations #1, #4 and #6. Reciprocation of pilot pin 310 on its working and retraction strokes in the portion of hole 206 which becomes link hook surface 114 also provides a second burnishing of the same to thereby provide a smooth finish on this surface.

Station #4 Press Punch and Die

Referring to FIGS. 12D and 11, in Station #4 the final step is performed in blanking the form of link 100. Station #4 is provided with a blanking punch 320 having a flat end face 322 and a shank 324 of longitudinally constant cross sectional thickness of the same contour as face 322. The contour of punch 320 is identical to the layout of link 100 as seen in the plan view thereof in FIG. 5 except for one important difference. Instead of following the hook eye 112 of link 100, punch 320 has a portion 330 (FIG. 12D) which fills this area of the link layout to provide a shear line bridging the central neck of strip opening 206 as registered in Station #4.

Station #4 is also provided with a complimentary blanking die forming an opening 326 in die plate 200 having the same contour as punch 320. Die opening 326 extends completely through die plate 200 and registers with a part catching chute (not shown) of the punch and die apparatus. Die opening 326 is also made uniformly slightly oversize relative to the contour of punch 320 in accordance with the conventional punch and die tooling clearance criteria.

Station #4 Operation

In the operation of Station #4, the pair of strip holes 130 and 206 which were punched in Station #1 and then successively advanced through and piloted in Stations #2 and #3 have been further advanced in travel direction T and are now registered in Station #4. The registered position of strip hole 130 is shown in hidden lines in FIG. 12D and is positioned entirely within the outline of the contour of punch 320 and associated die opening 326. However, only that portion of strip hole 206 shown in hidden lines in FIG. 12D is registered within the punch and die opening contour. The remaining half of strip hole 206 overlies the flat upper surface of die block 200 on which strip 204 slides, and hence this half of strip hole 206 is positioned out of registry with die opening 326.

Hence, as punch 320 is forced downwardly on its working stroke in Station #4 to bring punch face 322 flat against the strip 204, punch 320 will strike and shear punch downwardly from strip 204 a finished workpiece having the final contour and configuration of link 100.

As seen in FIG. 12D (as well as in FIGS. 12E and 12F), it will be noted that the portion of punch 320 indicated at 330 bridges the central neck of strip opening 206 as it pierce blanks strip 204 to thereby leave open the mouth of link hook eye opening 112, (see also FIG. 5). The finished link 100 thus sheared from strip 204 is driven downwardly through die opening 326 into the part collection chute and thereby cleared from strip 204.

Station #5

Figures 12E, 12F:
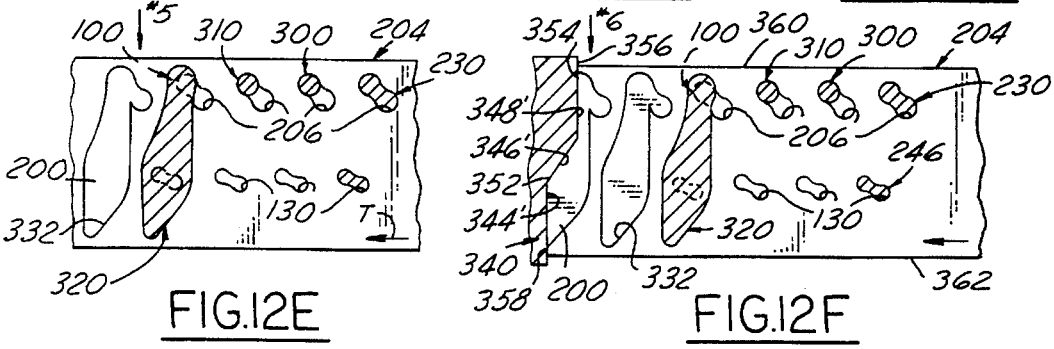

Referring to FIGS. 12E and 11, Station #5 is an "empty" station containing no punch or pilot tooling or associated die openings. Thus, as seen in FIG. 12E, the contour of the blanked-out opening 332 in strip 204 as previously and progressively formed by piercing portion 230 of punch 214 and by punch 320 in Stations #1 and #4 respectively, has been advanced in travel direction T from Station #4 by the next macine cycle to now occupy the empty space of Stations #5. Since Station #5 is thus an "empty" station, it advantageously provides a separation zone along strip 204 to thereby allow the sufficient intervening metal structural to be provided in die block 200 for adequate strength in the die block material between the concurrent punch blanking and cut-off operations occurring simultaneously in Stations #4 and #6 respectively.

Station #6 Punch and Die Tooling and Operation

Station 6 constitutes the last operating station of the punch and die tooling apparatus of the invention, as well as the last step of the method of the invention involved in forming link 100. Referring to FIGS. 12F and 11, the Station #6 punch and die tooling comprises a cut-off punch 340 having a flat bottom face 342 and a stepped cut-off edge consisting of a straight portion 344 an angled portion 346 and another straight portion 348 offset from portion 344 as defined by the intersection therewith of corresponding punch side surfaces 344', 346', 348' (FIG. 12F).

Die holder 200 has a corresponding downstream cut-off edge defined by the intersection of edge end surfaces 350, 352 and 354 perpendicularly with the upper face of die holder 200, and which are complimental to punch side faces 344', 346' and 348' respectively. Punch 340 and the left hand edge of die holder 200 are oriented and cooperate with the intermittent strip feed of strip opening 322 from Stations #5 to Station #5 to form a staggered cut-off line which intersects strip 204 at the narrowest points 356 and 358 in the opposite side margins of strip 204. FIG. 13 illustrates the scrap piece 370 severed from strip 204 in Station #6, with the companion shear lines 356' and 358' indicated thereon. Hence, the only strip portions severed are those remaining between the right hand longitudinal edge 360 of strip 204 (as viewed in direction T strip travel) and the closest adjacent portion of strip opening 332; and between the left hand edge 362 of strip 204 and the closest adjacent surface of strip opening 332. The location of these strip cut off points thus minimizes the amount of strip material to be severed to achieve the end cut-off function at the downstream end of the strip feeding apparatus.

As will now be understood from the foregoing, operation of the punch and die apparatus of the invention described previously with reference to FIGS. 11–21, as operated to preform the steps of the method of the invention, enables continuous, rapid and economical manufacture of links 100 with precision accuracy on a mass production basis with a minimum of scrap loss. In accordance with the working example specifications and parameter set forth hereinabove, links 100 can be made successfully at the rate of 150 per minute from a strip of metal sheet material 204 having the following specifications:

| | |
|---|---|
| Thickness of sheet 204 | .070 in 1.77 mm |
| Width of strip 204 | 1.362 in 34.6 mm |
| Material of strip 204 annealed spring steel or 400 series stainless steel | (C-1074) |

After the progressive die stamped link part 100 has been formed as described hereinabove, the only further operation required to finish the same is a conventional tumble deburring machine operation in which the final blanked shape of link 100 is tumble deburred to remove any burrs or protrusions protruding beyond the opposed metal surfaces of link 100. This final deburring operation insures that link 100 as so finished can slide freely over another adjacent metal surface without snagging or binding.

Modified Clipper Cutting Blade Link

Referring to FIG. 9, a modified cutting blade link 100' is illustrated in side elevational view which is identical in outside contour to the prior cutting blade link 100, utilized in the nail clipper of the aforementioned Clark '507 patent and described previously hereinabove, except for having a modified hook portion 102' and associated modified point 104' and hook eye edge surface 114'. Link 100' has the same pushing edge 116 as link 100. Instead of providing the two separate circular holes 40 and 74 (for engagement with link 100 and the release pin 70 of the '507 patent respectively), blade 26 need only be provided with one opening 40 since when it is used with link 100' the blade is non-releasable.

Link 100' is made by the same method as link 100 but has a somewhat longer hook portion 102' than portion 102 of link 100 so that its pointed end 104' protrudes further toward surface 116 so that hook 102' can not be withdrawn from blade hole 40 by pivoting link 102' by finger release pressure on tab 128 while link 102' is in assembled operable relation with blade 26 and pin 34 in clipper 10. However, link 102' can be initially installed in subassembled hooked relation with blade 26 by orienting link 102' upwardly beyond its operational angular range of orientation to blade 26 when in final assembly with clipper 10.

Further Features and Advantages

From the foregoing description, it will now be apparent that the improved link 100, and improved method and apparatus for making the same in accordance with the invention as described and illustrated previously herein, amply fulfill the aforestated objects as well as providing many novel features and advantages over link 32 of the Clark '507 patent and corresponding link 44 of the Reiswig '190 patent. Link 100 is directly substitutable as replacement for either of these aforementioned prior art links without requiring any change in the remaining existing structure of the commercial animal nail clipper and artificial human nail clipper of these respective patents. This is a major advantage in and of itself.

It is to be noted in this regard that the illustration of retainer 20 in FIGS. 1 and 3 of the Reiswig '190 patent is incorrect insofar as retainer 20, as correctly shown in FIG. 5 of the Reiswig '190 patent and as used commercially, terminates at its rearward end flush with the rearward end of spacer 26, i.e., it does not extend rearwardly of spacer 26 over blade 24 as shown in FIGS. 1 and 3. Hence in practice there is adequate space above blade 24 for the provide clearance to upwardly protruding hook 102 of link 100 when the same replaces link 44 in accordance with the present invention.

The mouth or eye 112 of hook 102 of link 100, being defined by the circular surface 114, and extending more than 180°, provides a curved undercut surface relative to hook end 104 which insures that hook 104 will more securely "wrap around" cutting blade 26 during pulling engagement of link 100 with blade 26 on the retraction stroke (referring to FIGS. 8A and 8B) than was possible with the rectangular notch in the prior links 32 or 44. Hence link 100 has a much greater resistance to pulling out of cutting blade 26 than the prior links even when such were provided with a flat undercut angle on the lower face of the rectangular notch. The semi-circular eye recess 112 in blade 100 acts like a fish hook, and provides a greater retaining angle than in the prior art acute angle links. Link nose 104 protrudes a slight distance above the upper face 80 of blade 26 (as viewed in FIGS. 1 and 4) and is reliably maintained in this attitude by both the force of spring 30 as well as the resolution of forces developed between link 100 and blade 26 on the retraction stroke. The curved link hook 102 thus insures that link 100 cannot be pulled out of the cutting blade 26 on the retraction stroke even if the blade binds or is restricted during the retraction stroke. Moreover, link 100 will remain engaged with the blade even if the trimmer is inadvertently dropped by the user, whereas the prior links 32 and 44 will sometimes disengage from the cutting blade when such dropage occurs.

In addition eye surface 114 provides a smooth bearing contour over the angular range of blade engagement because it is a curved surface with a constant radius of curvature and also because it is a smooth surface due to being produced by the circular punch surface of one of the lobes 232, 234 and due to the subsequent burnishing action in two stages by pilot pins 300 and 310. Hence the clipper action is smoother and less frictional resistance forces are developed in its operation.

Link 100 also retains the major advantage of easy blade removal without taking the clipper assembly apart, Link 100 has a large tab 128 at its rearward end easily finger operated for pivoting the front end of the link completely out of engagement with cutting blade 26, as set forth in the Clark '507 patent. Link 100 also can be positioned behind the rear edge 69 of blade 26 with nose surface 106 abutting thereagainst to push the cutting blade and thereby completely eject the same by squeezing the clipper handles. Hence link 100 works for this purpose at least as well as prior link 32 when replaced in the animal nail clipper structure of the Clark '507 patent.

The configuration and construction of link 100 also cooperates with the improved method and apparatus of the invention in providing further advantages. The prior links 32 and 44 had two small diameter holes for respectively receiving the handle pivot pin and spring hook that required correspondingly small and hence delicate pierce punches to form the same, thereby causing punch breakage problems and/or burr holes. This also led to problems with "slug return". By contrast, link 100 has a fish hook configuration for the front blade engaging eye opening 112. Because this opening is a segment of a circle, it is easier to stamp, and the larger diameter punch and die tooling 214 and 210 will hold up longer in production.

Moreover, the two small diameter holes of the prior link are replaced in link 100 with the much larger "dumb bell" shaped opening 130. Hence a single punch 216 can be employed having a rigid cross sectional configuration and substantially greater cross sectional area than the old small diameter hole punches. Likewise the die opening 220 is much larger than those of the prior dies. This makes the punch and die tooling easier and less expensive to construct and much more rigid and strong, thereby providing greater accuracy and longer life in use of the tooling. Not only is the punch more durable because of its larger size, it produces less burrs on the parts because of the improved ratio of hole size to stock thickness, and the holes as punched are much more uniform in production.

Another and unexpected advantage of the provision of the "figure 8" or "dumb bell" cross sectional configuration provided in punches 214 and 216 is the elimination of the aforementioned slug return problem that occurred frequently with the prior small diameter punches. "Slug return" can cause the strip stock to jam up so that the press must be stopped and the die cleared before production can be resumed. This expensive and costly procedure is eliminated by the method, apparatus and actuating link configuration working in cooperation with one another in accordance with the present invention.

Additionally, although it might at first must seem wasteful to punch an "oversize" opening 206 in strip 204 when only half of this opening is utilized in the final product, i.e., opening 112 in link 100, the "unused" portion of hole 206 does not thereby create an increase in scrap loss because of the efficient nesting pattern provided in the progression punching layout, as best seen in FIGS. 12E and 12F. On the other hand, this "oversize" opening feature enables the advantageous use of the large cross section "figure 8" punch 214 with its generous radii of curvature, making the punch easier to build and maintain.

The smaller "figure 8" punch 214 also has these corresponding advantages, and yet the resulting "figure 8" shape of opening 130, with its narrow but open central waist works as well as the two prior small holes for retaining spring hook 55 and pivot pin rivet 34. It is to be noted in this regard that, as best seen in FIGS. 1 and 4, the thrust and reaction forces exerted between pivot pin 34 and link 100 during both the push and pull modes of operation of the clipper are directed against the circular surface at the associated end of opening 130 rather than toward the central surfaces 136 and 138 of opening 130. The same action is true relative to spring hook 55 and the opposite circular end of opening 130. Hence the single dual-purpose hole 130 works at least as well as the prior two small holes in link 32 with respect to the retention and engagement of the associated spring and pivot pin parts.

The perimeter configuration of link 100 provides further advantages in production and operation of link 100. The perimeter of hook 102 and hook eye 112 link 100 has generous radii at the intersections of all of its corners, as contrasted with the right angle intersections at the corners of the notch surfaces 42, 44 and 46 and link 32 and as illustrated in the Clark '507 patent. Hence the problems posed by the prior punch perimeter configuration, with its straight edges and right angle or acute angle corners that were susceptible of die breakage and excessive wear, are also overcome. Moreover, link nose 102, which forms the outside of a fish hook configuration, has a generous radius which makes blanking punch 320 and associated die opening 326 easier to construct and maintain. Because mouth 112 of link 100 is made circular and on a constant radius of curvature, surface 114 can be made to a closer tolerance than could be obtained with the prior rectangular notch opening of link 32.

Obtaining these closer tolerances in production also means there is less play or gap in the engagement between link 100 and cutting blade 26. This not only produces a smoother action during the cutting stroke; it also enables increased travel because of the reduced lost motion produced between link 100 and blade 26 when push/pull reversal occurs at the end of the cutting stroke of the blade. This in turn enables the cutting blade 26 to be made to a slightly shorter length, thereby saving material cost in production of the blade.

A still further increase in blade travel is made possible by the improved configuration of nose 102 of link 100. The outside radius defined by hook surface 106, as well as the inside radius defined by surface 114, enables nose 102 to be made thinner in the major plane of link 100 than the corresponding portion of prior link 32. Hence there is less metal between the cutting blade and link hook 102 when the same engages the stop 52 of retainer 18 at the end of the cutting stroke. Consequently, blade travel is increased, thereby enabling the cutting blade to be made even shorter to thereby provide further material savings.

It is to be understood that the aforementioned features and advantages of the improved link 100 of the invention, and the improved apparatus and method for manufacture of the same in accordance with the invention, are equally applicable with respect to use of link 100 as replacement for link 44 in the artificial or natural human nail clipper of the aforementioned Reiswig '190 patent, resulting in a corresponding reduction in manufacturing cost and improvement in its ease and reliability of operation and greater useful life.

It will also be understood that link 100 (or 100') could be made from much thinner sheet stock, and two or more of such thinner links used in side-by-side assembly in clipper 10 to conjointly provide sufficient strength for actuating blade 26. Such multi-ply links may be adhesively laminated or otherwise suitably fixed together if desired, but need not be since they are trapped to operate in loose side-by-side relationship by pin 34 and spring hook 55, as well as by blade hole 40 when in operable assembly in clipper 10.

Also the hook 102 of link 100 may be bent toward eye surface 116 as a final operation after subassembly to blade 26 in order to provide the type of non-release engagement therewith as link 100' when in operable assembly in clipper 10.

Further, blade 26 can be made with a straight or other form of cutting edge if desired for certain cutting applications, such as in the aforementioned Reiswig '190 patent.

It is also to be understood that, although the foregoing description and drawings describe and illustrate in detail a successful working embodiment of the present invention, to those skilled in the art to which the present invention relates the present disclosure will suggest many modifications and constructions as well as widely different embodiments and applications without thereby departing from the spirit and scope of the invention. The present invention, therefore, is intended to be limited only by by the scope of the appended claims and the applicable prior art.

I claim:

1. A cutting blade actuating link for releasably engaging push pull latch bar means disposed in the major plane of a thin flat planar cutting blade of a guillotine-type clipper, said link being adapted to be operably pivotally coupled to one of a pair of opposed clipper handles and to one end of a tension coil spring for operably driving via the push and pull latch bar means of the blade on a cutting stroke when the handles are squeezed together and for retracting the cutting blade when the handles are separated by the spring, said link comprising in its entirety a thin flat planar metallic body having an integral hook formation at one end adapted for insertion into the blade forward of the bar means, an integral finger tab extension formation at the end of said body opposite said hook end and aperture means formed through said body perpendicular to the major plane thereof and intermediate the opposite ends thereof adapted for receiving pivot connection means for the pivotal coupling of said link to one of said handles for bodily swinging movement in the major plane of said body and parallel to handle movement, said link hook formation comprising an inside peripheral edge concave surface on a radius of curvature in an incomplete circle disposed in the major plane of said body to thereby define a hook eye opening having a gap in an adjacent edge of said body defining a mouth entrance to said hook eye opening to thereby provide a hook inside forward end edge surface inclined generally at an acute angle relative to the longitudinal axis of said body, said hook eye opening being adapted for releasably sideways receiving via the hook mouth the bar means of the blade for blade actuating push-pull reciprocating operation therebetween, and wherein said hook has an outside peripheral forward end convex edge surface defined by a generally constant radius of curvature so as to cojointly form with said concave inside edge surface said hook formation at the end of said link with a slightly tapering thickness dimension in the major plane of said body progressively narrowing towards a free end of the hook at a rounded intersection of said inside and outside edge surfaces.

2. A cutting blade actuating link for releasably engaging push pull latch bar means disposed in the major plane of a thin flat planar cutting blade of a guillotine-type clipper, said link being adapted to be operably pivotally coupled to one of a pair of opposed clipper handles and to one end of a tension coil spring for operably driving via the push and pull latch bar means of the blade on a cutting stroke when the handles are squeezed together and for retracting the cutting blade when the handles are separated by the spring, said link comprising in its entirety a thin flat planar metallic body having an integral hook formation at one end adapted for insertion into the blade forward of the bar means, an integral finger tab extension formation at the end of said body opposite said hook end and aperture means formed through said body perpendicular to the major plane thereof and intermediate the opposite ends thereof adapted for receiving pivot connection means for the pivotal coupling of said link to one of said handles for bodily swinging movement in the major plane of said body and parallel to handle movement, said link hook formation comprising an inside peripheral edge concave surface on a radius of curvature in an incomplete circle disposed in the major plane of said body to thereby define a hook eye opening having a gap in an adjacent edge of said body defining a mouth entrance to said hook eye opening to thereby provide a hook inside forward end edge surface inclined generally at an acute angle relative to the longitudinal axis of said body, said hook eye opening being adapted for releasably sideways receiving via the hook mouth the bar means of the blade for blade actuating push-pull reciprocating operation therebetween, and wherein said aperture means comprises a dumb bell shaped through-opening having oppositely disposed curved ends and a constricted central portion to thereby define a pair of oppositely disposed concavely curved opening edge surfaces each extending for more than 180°, one of said pair of ends of said opening being dimensioned to receive a pivot pin coaxially therethrough adapted for mounting said blade to said handle, the other of said pair of ends of said opening being dimensioned to receive therethrough the hook end of the guillotine clipper spring.

3. The link as set forth in claim 2 wherein said hook has an outside peripheral forward end convex edge surface defined by a generally constant radius of curvature so as to cojointly form with said concave inside edge surface said hook formation at the end of said link with a slightly tapering thickness dimension in the major plane of said body progressively narrowing towards a free end of the hook at a rounded intersection of said inside and outside edge surfaces.

4. The link as set forth in claim 1 wherein said link body is somewhat narrow diamond shaped in its major plane with its widest portion having a maximum planar dimension transverse to the longitudinal axis of the link generally midway between the opposite longitudinal ends of said link, and wherein said link aperture means are generally disposed in said widest portion of said link body.

5. The link as set forth in claim 4 wherein said aperture means comprises a dumb bell shaped through-opening having oppositely disposed curved ends and a constricted central portion to thereby define a pair of oppositely disposed concavely curved opening edge surfaces each extending for more than 180°, one of said pair of ends of said opening being dimensioned to receive a pivot pin coaxially therethrough adapted for mounting said blade to said handle, the other of said pair of ends of said opening being dimensioned to receive therethrough the hook end of the guillotine clipper spring.

6. In a clipper for trimming a human or animal nail having:

a clipper body including a first handle;

a second handle opposing the first handle and pivotally coupled to said clipper body;

a planar nail holder having a first side, a second side, a proximal end attached to the clipper body and a distal end, the holder having a crescent shaped aperture with a bight portion thereof extending toward the distal end for receiving the finer nail when inserted from the first side;

a planar blade having a blade edge;

means for retaining the blade in slidable face-to-face relation with the second side of said nail holder; and link means responsive to relative movement of said handles for sliding the blade from an initial position toward the distal end of said blade holder such that the blade edge passes over the aperture in the nail holder and retracts to its initial position, said link means comprising a link pivotally connected to said second handle at a point spaced from the pivotal connection of said second handle to the clipper body, said blade including a push-pull latch bar means for releasably coupling the link to the blade; and spring means coupling the link and the clipper body to urge said blade away from the distal end of the nail holder, the improvement in combination therewith wherein said link comprises in its entirety a thin flat planar metallic body having an integral hook formation at one end adapted for insertion into the blade forward of the bar means, an integral finger tab extension formation at the end of the link body opposite said hook end and aperture means formed through said link body perpendicular to the major plane thereof and intermediate the opposite ends thereof adapted for receiving pivot connection means for the pivotal coupling of said link to one of said handles for bodily swinging movement in the major plane of said link body and parallel to handle movement, said link hook formation comprising an inside peripheral edge concave surface on a radius of curvature in an incomplete circle disposed in the major plane of said link body to thereby define a hook eye opening having a gap in an adjacent edge of said link body defining a mouth entrance to said hook eye opening to thereby provide a hook inside forward end edge surface inclined generally at an acute angle relative to the longitudinal axis of said link body, said hook eye opening being adapted for releasably sideways receiving via the hook mount said latch bar means of the blade for blade actuating push-pull reciprocating operation therebetween.

7. The clipper as set forth in claim 6 wherein said link hook formation has an outside peripheral forward end convex edge surface defined by a generally constant radius of curvature so as to cojointly form with said concave inside edge surface said hook formation at the end of said link with a slightly tapering thickness dimension in the major plane of said body progressively narrowing towards a free end of the hook at a rounded intersection of said inside and outside edge surfaces.

8. The clipper as set forth in claim 6 wherein said link body is somewhat narrow diamond shaped in its major plane with its widest portion having a maximum planar dimension transverse to the longitudinal axis of the link generally midway between the opposite longitudinal ends of said link, and wherein said link aperture means are generally disposed in said widest portion of said link body.

9. The clipper as set forth in claim 8 wherein said aperture means comprises a dumb bell shaped through-opening having oppositely disposed curved ends and a constricted central portion to thereby define a pair of oppositely disposed concavely curved opening edge surfaces each extending for more than 180°, one of said pair of ends of said opening being dimensioned to receive a pivot pin coaxially therethrough adapted for mounting said blade to said handle, the other of said pair of ends of said opening being dimensioned to receive therethrough the hook end of the guillotine clipper spring.

10. In a clipper having a first handle, a blade receiving guideway, a work holder in said guideway and extending at one end therefrom, a second handle having a first pivot connection with said first handle at a point spaced laterally from said guideway, a cutting blade slidably received in said guideway for movement in cutting and retraction strokes and having a first surface slidably engaging one side of said holder, a link having a link aperture forming part of a second pivot connection with said second handle at a point spaced rearwardly of said blade and intermediate said guideway and said first pivot connection, a tension coil spring connected at one end to said first handle and at the other end to said link at a point disposed between said second pivot connection and said guideway and on the side of said second pivot connection remote from said guideway, said link extending with its longitudinal axis at an oblique angle to the longitudinal axis of said blade, said link having a projection at the end thereof closest to said blade, said blade having an aperture defining a first marginal latch bar edge extending transverse to the direction of movement of said blade, said blade aperture being adapted to receive said projection to releasably couple said link to said blade such that said projection engages said first marginal edge to pull said blade in its retraction stroke, said blade having a second marginal latch bar edge spaced longitudinally of said blade from said first marginal edge, said link being operable to push against said blade second marginal edge in its cutting stroke, said link having a manipulating extension projecting into the space defined between said handles on the side of said second pivot connection remote from said blade to facilitate pivoting said link about the axis of said second pivot connection to disengage said link from said blade, the improvement in combination therewith wherein said link aperture comprises a dumb bell shaped through-opening having oppositely disposed curved ends and a constricted central portion to thereby define a pair of oppositely disposed concavely curved opening edge surfaces each extending for more than 180°, one of said pair of ends of said opening being dimensioned to receive a pivot pin coaxially therethrough and cooperable therewith as said second pivot connection for mounting said link to said handle, the other of said pair of ends of said opening being dimensioned to receive therethrough said other end of said spring.

11. The clipper as set forth in claim 9 wherein said link has a curved notch adjacent its forward end defining the rearward portion of said projection and said projection also has a convexly curved free end edge surface, said link notch having a concavely curved interior edge surface and being adapted in the pull stroke to hook with and ride on said blade first marginal edge surface and wherein one of said surfaces is also adapted to slidably abut in pushing relation of said blade second marginal edge during the application of force to said blade via said link in response to said handles being squeezed together.

12. The clipper as set forth in claim 11 wherein said one blade pushing surface comprises said notch interior surface.

13. The clipper as set forth in claim 10 wherein said link projection comprises an integral hook formation inserted into said blade aperture, said link hook formation comprising an inside peripheral edge concave surface on a radius of curvature in an incomplete circle to thereby define a hook eye opening having a gap in an adjacent edge of said link defining a mouth entrance to said hook eye opening to thereby provide a hook inside forward end edge surface inclined generally at an acute angle relative to the longitudinal axis of said link, said hook eye opening being adapted for releasably sideways receiving via the hook mouth said latch bar marginal edges of said blade for blade actuating push-pull reciprocating operation therebetween.

14. The clipper as set forth in claim 13 wherein said link is somewhat narrow diamond shaped in its major plane with its widest portion having a maximum planar dimension transverse to the longitudinal axis of the link generally midway between the opposite longitudinal ends of said link and wherein said link aperture is generally disposed in said widest portion of said link.

15. The clipper as set forth in claim 14 wherein said link hook formation has an outside peripheral forward end convex edge surface defined by a generally constant radius of curvature so as to cojointly form with said concave inside edge surface said hook formation at the end of said link with a slightly tapering thickness dimension in the major plane of said link progressively narrowing towards a free end of said hook formation at a rounded intersection of said inside and outside edge surfaces.

16. The link as set forth in claim 2 wherein said link body is somewhat narrow diamond shaped in its major plane with its widest portion having a maximum planar dimension transverse to the longitudinal axis of the link generally midway between the opposite longitudinal ends of said link, and wherein said link aperture means are generally disposed in said widest portion of said link body.

17. The link as set forth in claim 2 wherein each of said pair of edge surfaces is formed on a constant radius of curvature and extends approximately 200°.

* * * * *